US009418804B2

(12) United States Patent
Gerving et al.

(10) Patent No.: US 9,418,804 B2
(45) Date of Patent: Aug. 16, 2016

(54) SWITCHING DEVICE

(71) Applicant: Eaton Electrical IP GmbH & Co. KG, Schoenefeld (DE)

(72) Inventors: Karsten Gerving, Bonn (DE); Volker Lang, Bonn (DE); Johannes Meissner, Bonn (DE); Ralf Thar, St. Augustin (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 5 days.

(21) Appl. No.: 14/135,601

(22) Filed: Dec. 20, 2013

(65) Prior Publication Data

US 2014/0175057 A1 Jun. 26, 2014

(30) Foreign Application Priority Data

Dec. 20, 2012 (DE) ..... 10 2012 112 774
Oct. 30, 2013 (DE) ..... 10 2013 111 953

(51) Int. Cl.
*H01H 33/18* (2006.01)
*H01H 9/44* (2006.01)
*H01H 9/36* (2006.01)

(52) U.S. Cl.
CPC ..... *H01H 33/182* (2013.01); *H01H 9/443* (2013.01); *H01H 9/36* (2013.01)

(58) Field of Classification Search
CPC ..... H01H 33/10; H01H 33/20; H01H 33/182; H01H 33/596; H01H 9/38; H01H 9/46; H01H 9/44; H01H 9/443; H01H 33/53
USPC ..... 218/26, 23, 27, 31, 36, 40, 1, 34, 157; 200/8 A, 11 A, 243; 335/130, 207, 201
See application file for complete search history.

(56) References Cited

U.S. PATENT DOCUMENTS 2,150,564 A 3/1939 Rowe
4,656,446 A * 4/1987 Chien et al. ..... 335/201
(Continued)

FOREIGN PATENT DOCUMENTS

DE 1186125 B 1/1965
DE 1202378 A 10/1965
(Continued)

OTHER PUBLICATIONS

Machine translation DE1202378 (Orig. doc. published Oct. 7, 1965).*

*Primary Examiner* — Renee S Luebke
*Assistant Examiner* — William Bolton
(74) *Attorney, Agent, or Firm* — Leydig, Voit & Mayer, Ltd.

(57) ABSTRACT

A switching device having at least one contact pair includes a first contact and a second contact, where at least the second contact is movable relative to the first contact. There is an extinguishing device with at least one extinguishing chamber for extinguishing an arc produced between the contacts, a first guide rail arrangement for guiding the arc with one direction of current and a second guide rail arrangement for guiding the arc with the second direction of current in said extinguishing chamber. Both guide rail arrangements have a first guide rail and a second guide rail, where both first guide rails starting from the first contact run in the opposite direction, and both second guide rails starting from the second contact run in the opposite direction. The first guide rails are connected with each other in an electrically conductive arrangement in the form of a closed loop.

15 Claims, 8 Drawing Sheets

(56) References Cited

U.S. PATENT DOCUMENTS

| | | | | | |
|---|---|---|---|---|---|
| 4,743,720 | A | * | 5/1988 | Takeuchi et al. | 218/24 |
| 4,963,849 | A | * | 10/1990 | Kowalczyk et al. | 335/201 |
| 5,004,874 | A | * | 4/1991 | Theisen et al. | 218/151 |
| 5,130,504 | A | * | 7/1992 | Moldovan et al. | 218/40 |
| 5,138,122 | A | * | 8/1992 | Moldovan et al. | 218/22 |
| 5,818,003 | A | * | 10/1998 | Moldovan | H01H 9/443 218/26 |
| 5,969,314 | A | | 10/1999 | Rakus et al. | |
| 6,417,474 | B1 | | 7/2002 | Rakus et al. | |
| 7,915,985 | B2 | | 3/2011 | Schmitz et al. | |
| 8,368,492 | B1 | * | 2/2013 | Theisen et al. | 335/201 |

FOREIGN PATENT DOCUMENTS

| | | | |
|---|---|---|---|
| DE | 2423660 | A1 | 12/1974 |
| EP | 0789372 | B1 | 8/1997 |
| EP | 2061053 | A2 | 5/2009 |
| FR | 741678 | A | 2/1933 |

* cited by examiner

SWITCHING DEVICE

CROSS-REFERENCE TO RELATED APPLICATIONS

Priority is claimed to German Patent Applications No. DE 10 2012 112 774.3, filed on Dec. 20, 2012, and DE 10 2013 111 953.0, filed on Oct. 30, 2013, the entire disclosure of each of which is incorporated by reference herein.

FIELD

The invention concerns a switching device for direct current operation that comprises at least one contact pair which contains a first contact and a second contact, where at least the second contact is movable relative to the first contact. The invention envisions an extinguishing device with an extinguishing chamber for extinguishing an arc produced between the contacts, a first guide rail arrangement for guiding the arc with a first direction of current in a first direction into said extinguishing chamber and a second guide rail arrangement for guiding the arc with a second direction of current in a second direction in the extinguishing chamber specified. Both guide rail arrangements each comprise a first guide rail and a second guide rail, where both first guide rails run starting from the first contact in opposite directions to each other, and the second guide rails run starting from the second contact in opposite directions to each other.

BACKGROUND

Switching devices with one or several current paths, which comprise fixed or movable contacts, are generally used for switching off currents in consumer networks. The movable contacts can be moved jointly between a closed position, where the movable and fixed contacts touch each other, and an open position, where there is a separating path established between the movable and fixed contacts, which are assigned to each other. When the movable contacts under load, i.e. under the current flow, are moved in the open position, arcs are formed along the separating paths. The burning time of the arc determines the switching time because the current flow is maintained between the contacts. Furthermore, the arcs produce a significant amount of heat, which cause the thermal destruction of the contacts and components of the switching chamber located near the contacts and thus result in reducing the useful life of the switching device. The arc must therefore be extinguished as quickly as possible by the arc extinguishing devices. The extinguishing devices separate the arcs, for example, into individual partial arcs. As soon as the arc voltages exceed the driving voltages, the arcs are securely extinguished.

The magnetic fields generated by the currents themselves are often used for extinguishing especially high currents to drive the forming switching arcs independently quickly away from the contacts toward the extinguishing devices, where they are finally extinguished.

In case of switching devices for direct current, the arc is not interrupted independently as in case of the zero passage of the alternating current. Therefore, in cases of direct current applications, blow magnets are used that generate a magnetic field with a given strength and orientation, which generates a deflecting force (Lorentz force) on the arcs that deflects the arcs to the arc extinguishing devices. In the extinguishing devices, the arcs are stretched, cooled, separated into partial arcs and extinguished in this manner.

Such a switching device as specified in the outset is known from EP 2 061 053 A2. For creating a switching device for direct current applications, it is recommended that the housing of a switching device for alternating current applications be used, where at least one magnet is provided in addition, which creates a magnetic field with field lines predominantly transverse to the isolation gaps of current paths of the alternating current switching device. There are three receiving regions in the housing for each single current path, where each current path is assigned a movable switching contact element as well as two fixed switching contact elements opposite to each other. The three movable switching contact elements can be moved together, between a closed position which corresponds to the switched-on state of the switching device, and an open position which corresponds to a switched-off state of the switching device. The individual current paths are each assigned two arc extinguishing devices in the form of extinguishing plates, arranged individually over one another and electrically insulated from each other. In addition, each current path has two separation sections which, when the movable switching contact elements are open, form between the ends of the movable switching elements and the first and second fixed switching elements which are allotted to the ends of the movable switching contact elements. On opening of the switching contact elements, an arc which can be extinguished with the help of arc extinguishing devices is formed along each separation section. In direct current applications, the arc cannot be extinguished at the zero current passage, as in alternating current applications, and therefore a magnetic field must be used in most direct current applications to drive the arc into an arc extinguishing device. This magnetic field is built up by permanent magnets, where a magnetic field is generated with field lines in a direction which runs transverse to the separation sections and creates a Lorentz force on the arcs that form along these separation sections which drives the arc in the direction of an arc extinguishing device. In this context, an arc between a first contact pair is driven in the direction of a first arc extinguishing device and the arc between a second contact pair is driven in the direction of the second arc extinguishing device. Since the movement of the arcs is dependent on the direction of the current, the switching device is only suitable for one current direction, i.e. polarity. If the switching device is operated in the opposite current direction, the arcs will not be driven into the arc extinguishing devices but in the opposite direction to a switching bridge. Even if the magnetic polarity of one of the arc extinguishing devices is reversed, one of the arcs would run towards a switching bridge, which would result in reduced lifetime, since the switching bridge or other part would be damaged or even destroyed in the long run.

The EP 0 789 372 B1 also shows a switching device of the type mentioned at the outset. A fixed contact is provided with a fixed arc runner which is circular arc-shaped. A movable arc runner is provided on a movable contact, where an arc can form between the two arc runners, which can be moved in different directions by the arc driver assembly in accordance with the direction of the current. In accordance with the direction of current, this is diverted around a center point, either in the first direction of rotation or in a second direction of rotation opposite to the first, where the center point corresponds to the center point of the fixed arc runner. An arc with the first direction of current is diverted into a first arc runner channel and an arc with a direction of current opposite to the first direction of current is diverted into the second arc runner channel. Both arc runner channels run around the center point and are arranged next to each other separated by an insulating wall. The arc runner channels are part of an extinguishing device for extinguishing the arc. Furthermore, the extinguishing devices comprise extinguishing plates which are radially oriented to the stationary arc channels. The extinguishing plates are arranged in such a way that they cover both the arc channels and, therefore, are part of both extinguishing devices.

In many known switching devices, the arc formed during switching is driven in a blowout field generated by a permanent magnet into an extinguishing chamber, for example, a deion extinguishing chamber, to be extinguished there. The guide rails of the arc guiding devices run from the contacts to the outside in diverging directions.

Depending on the polarity of the current, immediately after its creation, the switching arc is driven by the Lorentz force away from the switching contacts along one of the two guide rail arrangements, which run diametrically apart, in the direction of the extinguishing chamber, where the arc is normally quickly extinguished when reaching the driving voltage.

In switching arcs with high energy content, especially with a high inductive share in the current circuit, it can happen that the arc entering the extinguishing chamber only loses part of its energy in the chamber and is not completely extinguished. In that case, re-ignitions can occur after passing through the extinguishing chamber by the arc moving from the outside end of the extinguishing chamber to the end of the guide rail and in certain cases running again in the direction of the contacts. Depending on the geometry of the switching chamber, the arc can also burn steadily at certain locations, for example at the terminations of the guide rails, which causes an extension of the burning time of the arc and therefore a higher thermal load on the switching chamber, which can cause a reduction of the electrical useful life of the switching device.

SUMMARY

In an embodiment, the invention provides a switching device for direct current operation. The device includes: a contact pair, which contact pair includes a first contact and a second contact, at least the second contact being movable relative to the first contact; and an extinguishing device including an extinguishing chamber configured to extinguish an arc produced between the first contact and the second contact. The extinguishing device includes a first guide rail arrangement configured to guide the arc with a first direction of current and a second guide rail arrangement configured to guide the arc with a second direction of current in said extinguishing chamber. Each of the guide rail arrangements includes a first guide rail and a second guide rail, wherein first guide rails, starting from the first contact, run in opposite directions. The second guide rails, starting from the second contact, run in opposite directions. The first guide rails are connected to each other in a conductive link forming a closed loop.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
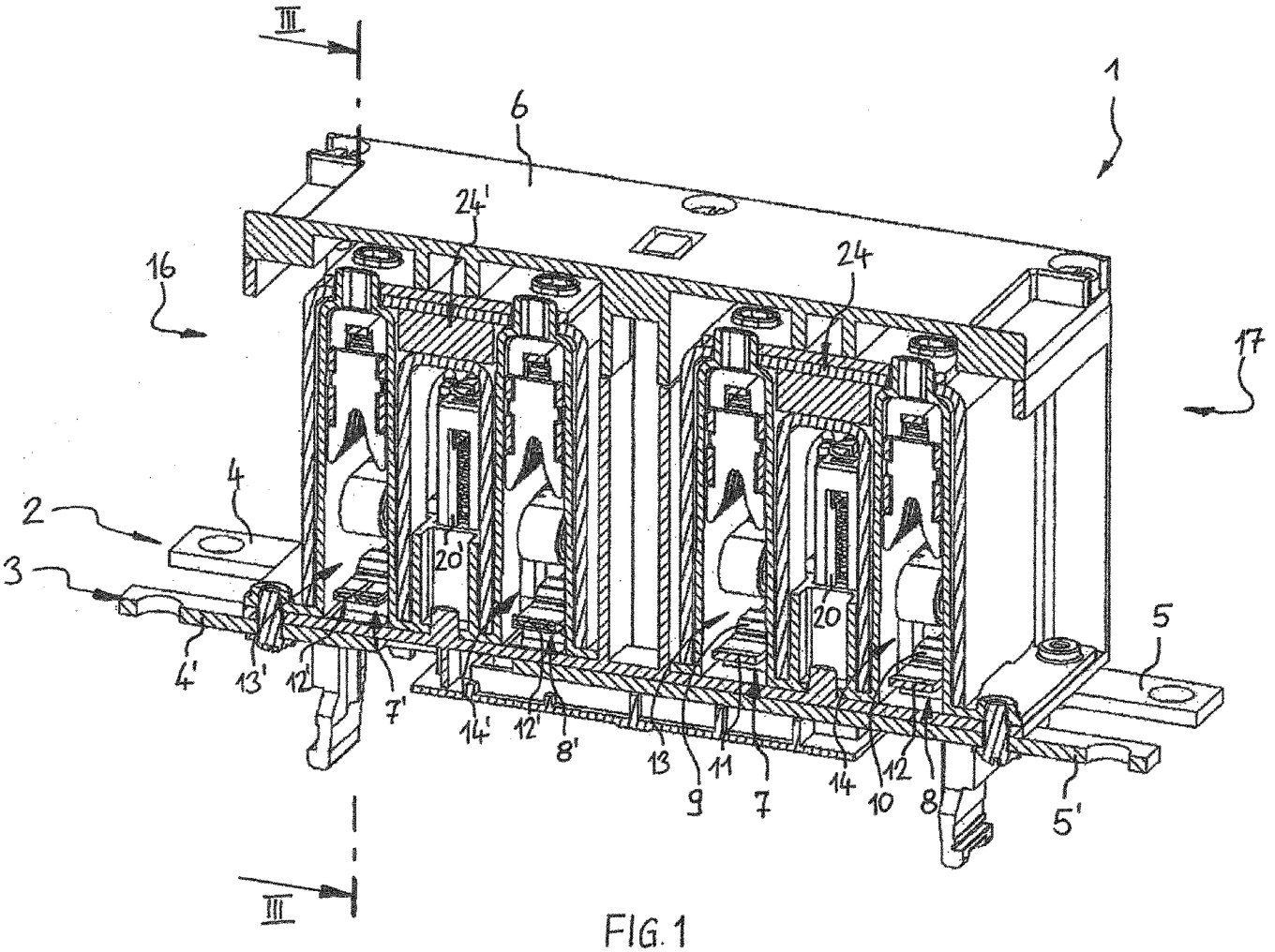
FIG. 1 shows a perspective longitudinal section of a switching device in accordance with this invention.

An aspect of the invention provides a switching device for direct current operation, comprising at least one contact pair, comprising a first contact and a second contact, where at least the second contact is movable relative to the first contact. The invention also envisions an extinguishing device with at least one extinguishing chamber for extinguishing an arc produced between the contacts, a first guide rail arrangement for guiding the arc with one direction of current and a second guide rail arrangement for guiding the arc with the second direction of current into said extinguishing chamber. Both guide rail arrangements comprise each a first guide rail and a second guide rail, where both first guide rails starting from the first contact run in the opposite direction to each other, and the second guide rails starting from the second contact run in the opposite direction to each other. The first guide rails are connected with each other in an electrically conductive arrangement in the form of a closed loop. Preferably, the guide rails are connected in an electrically conductive arrangement on the side of the second contact facing away from the first contact.

The term "closed loop" means that there is a kind of closed electrical circuit that has an optional geometry, for example, a ring shape. In this case, the guide rails should be considered "closed", when they have short interruptions, as long as the arcs can bridge these interruptions without any difficulty.

An aspect of this invention is to ensure that even arcs with a high energy content are kept in a continuous constant motion in the blowout field of the permanent magnet to ensure that the thermal load of different areas within the switching chamber is reduced significantly and the expected lifetime of the switching chamber is significantly increased accordingly. In an embodiment, the first guide rails on the side of the fixed contact connected to each other and thus closed. In this case, the outgoing ends of both guide rails are connected to each other, preferably with a connecting bracket. The terms switching chamber and switching device will be used below as synonyms of each other.

Preferably, the extinguishing device comprises an extinguishing chamber, and the guide rail arrangements are arranged in a manner that the arcs are driven in the extinguishing chamber independent of the direction of current and the running direction of the arc.

For technical reasons of manufacturing, it can be advantageous when the guide rail arrangements consist of several parts, which are connected friction-locked during the assembly process. The two guide rails can be connected to each other by a connecting bracket. In an especially preferred embodiment, the connecting bracket has a cut where the cut runs approximately in the middle along the closed loop for centering the arc, that is, in the direction of movement of the base point of the arc. The base points of the arc preferably run along sharp, conductive edges. When the outside edges of the bracket are covered by the attaching housing walls, the arc is advantageously conducted on the edges of the middle cut. The arc is centered in this manner, displaced from the ideal middle position only by half the width of the gap. Additionally, the gases produced during the switching operation can be blown out through the cut.

It is generally advantageous, however, to avoid the number and/or size of the brackets or notches transverse to the direction of movement of the arc in the guide rail arrangement, because partial arcs can form in the respective areas and these cause a significantly increased wear on the components. In a preferred embodiment, both first guide rails make up an essentially U-shaped single conductive element, by preferably not having any joints. The conductive element can be an advantageously shaped component or produced cost-efficiently as a simple punched and bent part.

An especially preferred embodiment also provides that the first contact is arranged at the single-piece conductive element. In an alternative embodiment, the single-piece conductive element has a cut, and the conductive element can be placed on the fixed contact support in such a manner that the first contact sticks out through the cut. The edges of the cut, which preferably adjoin the sloped sides of the contact, and are preferably resilient, establish an electrical connection between the contact and the conductive element. In this arrangement, the arc does not have to overcome an insulating soldering material, as it can go easily from the contact to the conductive element.

The extinguishing chamber can be fit between the two first guide rails, to ensure that the arcs are driven efficiently into the extinguishing chamber. The extinguishing chamber is preferably designed as a deion extinguishing chamber with a multitude of conductive extinguishing plates that are electrically insulated from each other and arranged parallel to each other.

The two second guide rails can be connected with each other in an electrically conductive arrangement in the form of a closed loop. Preferably, the two second guide rails are connected in an electrically conductive arrangement on the side of the second contact facing away from the first contact. On the side of the movable contact, the terminations of the guide rails bent in the direction of the underside of the contact (soldered side) are extended in such a manner that they form a partially or completely closed loop, for example, shaped as a ring or an ellipsis. The second guide rails are then connected to each other in a ring shape and they are shaped as a single piece.

In a preferred embodiment, the second contact is arranged on a contact piece which is movable as compared with the first contact, and the second guide rails make up a shared separate integral component, which is connected to the contact piece.

Due to manufacturing considerations, the guide rail arrangement can be made preferably of two separate components of a simple geometry. During the device-mounting process, the components are connected securely to each other using the appropriate method. Besides the advantage of a more simple production process, a guide rail manufactured as a separate component can be made of a lighter, thermally more resistant material while avoiding the drawbacks of copper which despite its good conductive properties is relatively heavy and soft.

For the harmonious propagation properties of the arc, it is especially advantageous if the base points of the arc preferably run along the middle of the guide rails because the probability of transferring the arc from the sides of the guide rails in areas in the vicinity of the walls of the switching chamber is significantly reduced, where it could cause high thermal stress on the material.

For this purpose, at least one of the guide rails can have a ridge that is elevated against the other guide rail at least partly in the direction of propagation of the arc. The ridge can be manufactured by applying impressions on the arc guide rails which run in the middle of the guide rails for the entire length of the guide rail or in critical sections.

For generating the Lorentz force on the arc, there is at least one arc driver assembly provided, which generates a magnetic field at least in the area of the contact pairs.

The arc driver assembly can comprise an external pole element and an internal pole element, where both pole elements are designed as U-shaped sections, each with a base bridge and two pole plates jutting out from the base bridge.

The inner pole element is placed preferably within the outer pole element, where at least one permanent magnet is provided between the base bridges of both pole elements, and there is a contact pair between one pole plate of the external pole element and a pole plate of the internal pole element.

The electrical switching device 1 comprises a total of two poles, i.e. two current paths, that is, a first current path 2 and a second current path 3. Basically, more than two current paths can be provided, where preferably two current paths in pairs are provided as described below. Both the current paths 2, 3 are each provided with a switching arrangement, as described in detail below, and can thus be electrically cut off. Both the current paths 2, 3 can each be integrated into a direct current circuit and can be used to interrupt a current flow.

Figure 2:
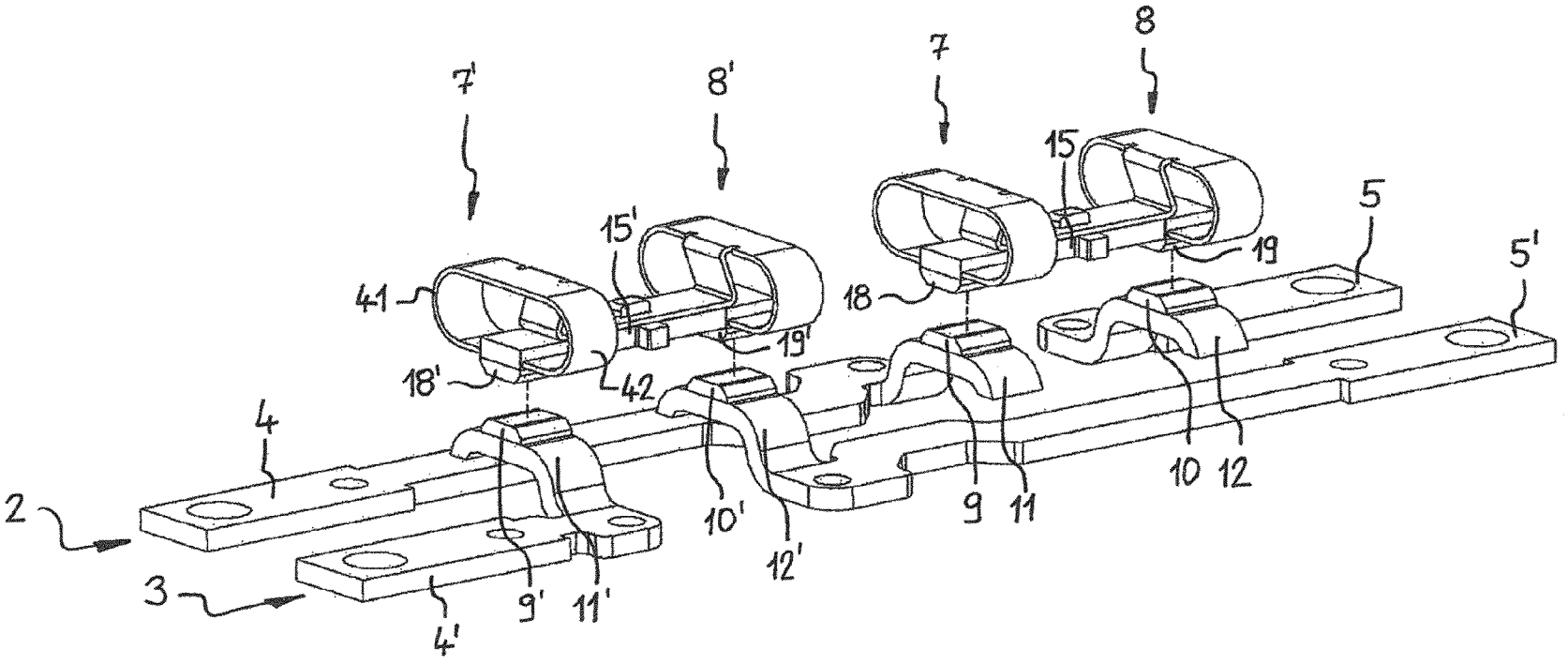
FIG. 2 shows a perspective diagram of the current path in accordance with FIG. 1.

FIG. 1 shows the switching device with a housing 6 and the current paths 2, 3 inside it. FIG. 2, which will now be described along with FIG. 1, shows the two current paths 2, 3.

The switching device 1 includes a housing 6, in which the switching arrangements are incorporated as described below. Current paths 2, 3 run next to each other from the first side 16 of the switching device 1 to a second side 17 of the switching device 1. The first current path 2 includes a first connection 4 and a second connection 5 for the purpose of connecting the first current path 2 with connections of a direct current circuit. Both the connections 4, 5 are located on opposite sides of the switching device 1 and protrude out of the housing 6. Correspondingly, the second current path 3 has a first connection 4' and a second connection 5', where the first connection 4' is located on the same connection side as the first connection 4 of the first current path 2. The second connection 5' of the second current path 3 is arranged on the same connection side as the second connection 5 of the first current path 2. In the description which follows, the first current path 2 will be described in more detail and is representative of both current paths 2, 3, where the second current path 3 is identically constructed, unless otherwise stated.

The first connection 4 leads to a first contact pair 7, which is arranged in the first switching chamber 13 of the housing 6. The second connection 5 leads to a second contact pair 8, which is arranged in the second switching chamber 14 of the housing 6. Both the switching chambers 13, 14 are electrically insulated from each other in the housing 6 and arranged in a direction from the first connection 4 to the second connection 5 in sequence and covering each other. The first connection 4 is electrically connected to a contact support in the form of a fixed contact support 11 on which a first contact 9 of the contact pair 7 is arranged. A second contact 9 is arranged movable relative to the first contact 18. The second contact 18 as shown in the FIGS. 1 and 2 is adjustable vertically. The second contact 18 is provided on an electrically conducting contact support in the form of a bridging contact member 15 which is adjustable across a switching bridge 20. In the switched-on state, the first contact 9 and the second contact 18 are kept connected to each other. In a switched-off state, as shown in one of the FIGS. 1 and 2, the first contact 9 and the second contact 18 have been kept disconnected from each other.

The second connection 5 leads to a first contact 10 of the second contact pair 8, which is arranged on another contact support in the form of a stationary contact support 12. A second contact 19 is kept movable relative to the first contact 10 of the second contact pair 8, which is also arranged on the bridging contact member 15 and is electrically connected to the second contact 18 of the first contact pair 7. Thus, both contact pairs 7, 8 can be opened or closed by adjusting the bridging contact member 15.

The fixed contact supports 11, 12 of both current paths 2, 3 are arranged in such a way that the first contacts (fixed contacts) are aligned on a common axis, where the axis runs parallel to a main direction of both current paths 2, 3

When switching the switching bridge 20 into an opened position, arcs that must be extinguished can form between the contacts 9, 18, 10, 19. An extinguishing device 21, 22 each is provided on the side of the first contacts 9, 10 facing away from the second contact 18, 19 for this purpose, where both extinguishing devices 21, 22 of both contact pairs 7, 8 are identically built. Here, a first extinguishing device 21 is assigned to the first contact pair 7 and a second extinguishing device to the second contact pair 8. Both extinguishing devices encompass extinguishing plates 23, which are electrically insulated from one another, arranged parallel to each other and are themselves electrically conducting. Thus, they form a deion extinguishing chamber.

An arc driver assembly 24 (FIG. 6) is provided to move arcs that form between the first contacts 9, 10 and the second contacts 18, 19 in the direction of the extinguishing devices 21, 22. The arc driver assembly 24 consists of an outer pole element 25 and an inner pole element 26. Both pole elements 25, 26 each have a base bridge 27, 28, from which a first pole plate 29, 30 and a second pole plate 31, 32 protrude, where both pole plates 29, 30, 31, 32 of the pole elements 25, 26 run parallel to one another. The inner pole element 26 has smaller dimensions than the outer pole element 25, so that the inner pole element 26 can be arranged inside the outer pole element 25. Here, all pole plates 29, 30, 31, 32 of both pole elements 25, 26 are parallel and spaced from one another. A gap is likewise provided between both base bridges 27, 28 of both pole elements 25, 26, where a permanent magnet 33 is arranged between both base bridges 27, 28. The first contact pair 7 is arranged between both the first pole plates 29, 30, and the second contact pair 8 is arranged between both the second pole plates 31, 32. The switching bridge 20 is arranged between the first pole plate 30 and the second pole plate 32 of the inner pole element 26.

Figure 6:
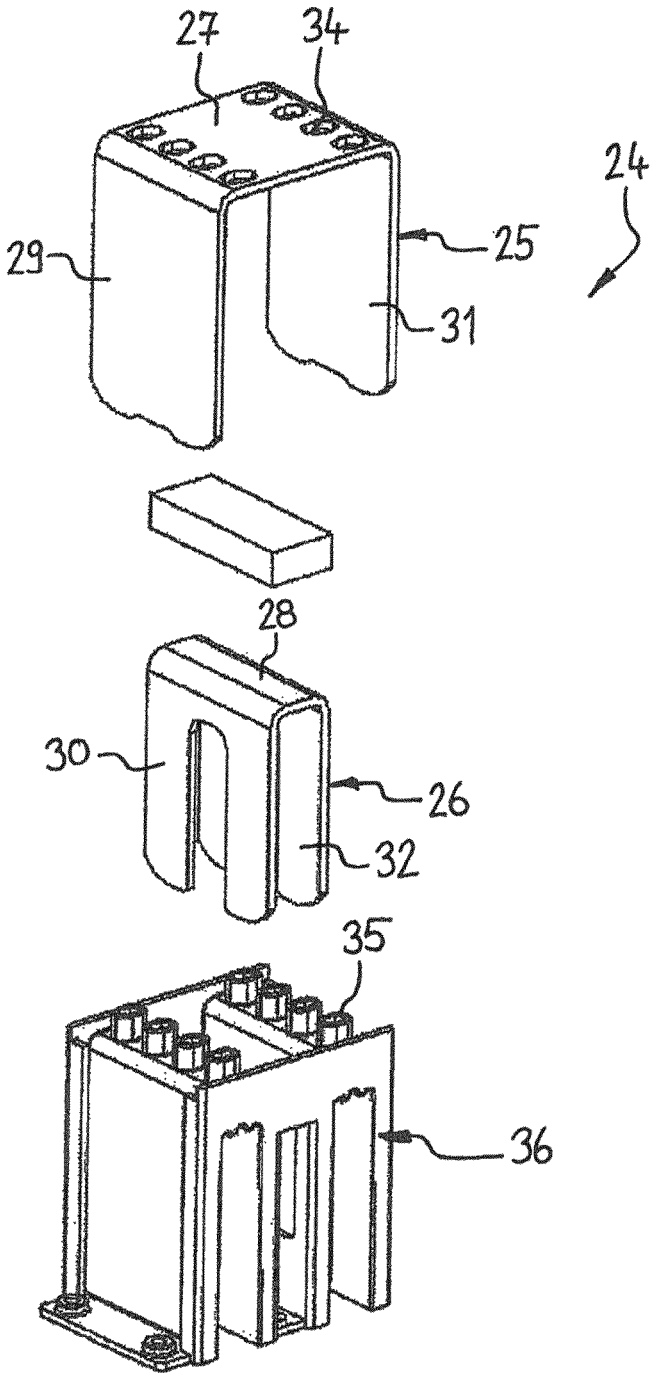
FIG. 6 shows an arc driver assembly of the switching device in accordance with FIG. 1.

The exact setup can also be seen on FIG. 6. Here, one can see that a multitude of openings 34 are provided in the base peg 27 of the outer pole element 25. These are meant for accommodating the exhaust ducts 35 of an insulating element 36. The insulating element 36 insulates the two switching chambers 13, 14 from each other, where the exhaust ducts 35 are meant for blowing out arc gasses from the switching chambers 13, 14 to the exterior.

The individual pole plates 29, 30, 31, 32 are arranged transverse to the current paths 2, 3 and generate a Lorentz force to act on an arc which forms between the contacts 9, 10, 18, 19, so that the arc can be driven into the extinguishing devices 21, 22.

Figure 3:
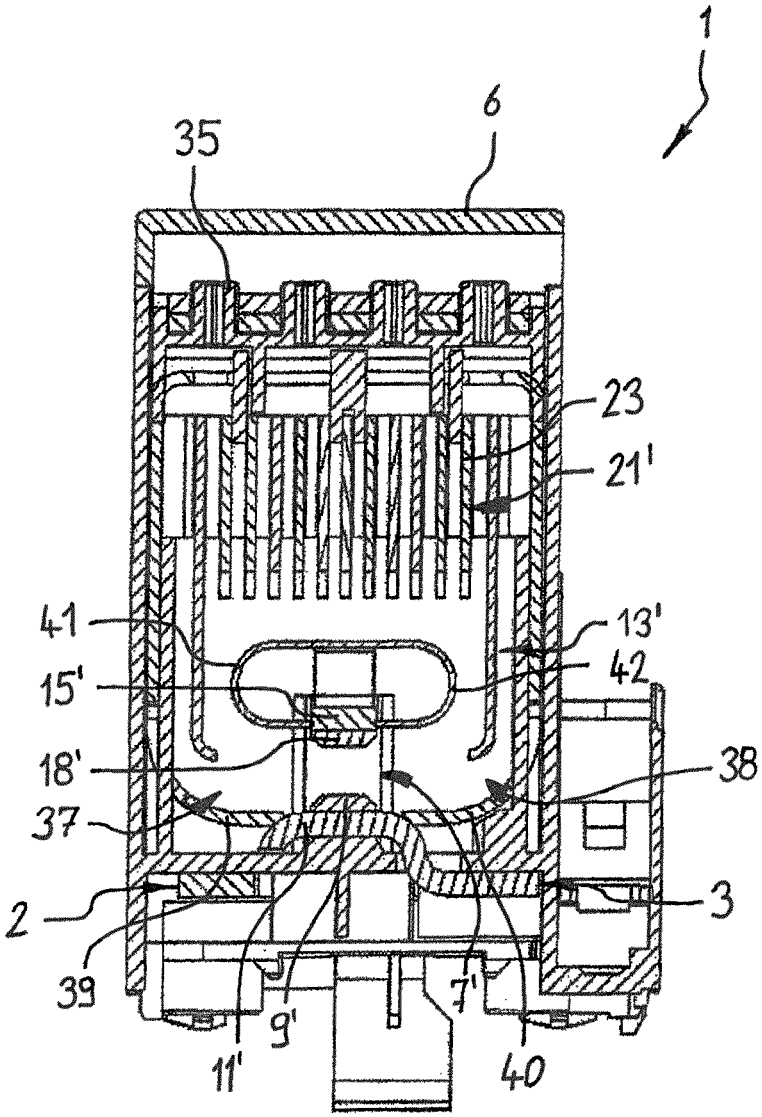
FIG. 3 shows a cross-section of the switching chamber of the switching device along section III-III in accordance with FIG. 1.

FIG. 3 shows a cross-section through the first switching chamber 13. A first guide rail arrangement 37 and a second guide rail arrangement 38 are provided for guiding an arc that forms between the first contact 9 and the second contact 18. The first guide rail arrangement 37 is meant for guiding an arc with a first direction of current into the first extinguishing device 21. The second guide rail arrangement 38 is meant for guiding an arc with a second direction of current into the first extinguishing device 21.

The closed guide rail arrangement 41, 42, starting from the movable second contact 18, is arranged on the side of the fixed contact, eccentric on the inside of the closed guide rail arrangement 39, 40, and in two areas the guide rail arrangement 39, 40 on the side of the fixed contact run in parallel with the guide rail arrangement 41, 42 on the side of the movable contact. In the area of the two contacts 9, 18, there is a minimum distance between the guide rails, and the distance is significantly higher within the parallel area located opposite to the first, where the extinguishing chambers are nested in.

Figure 4:
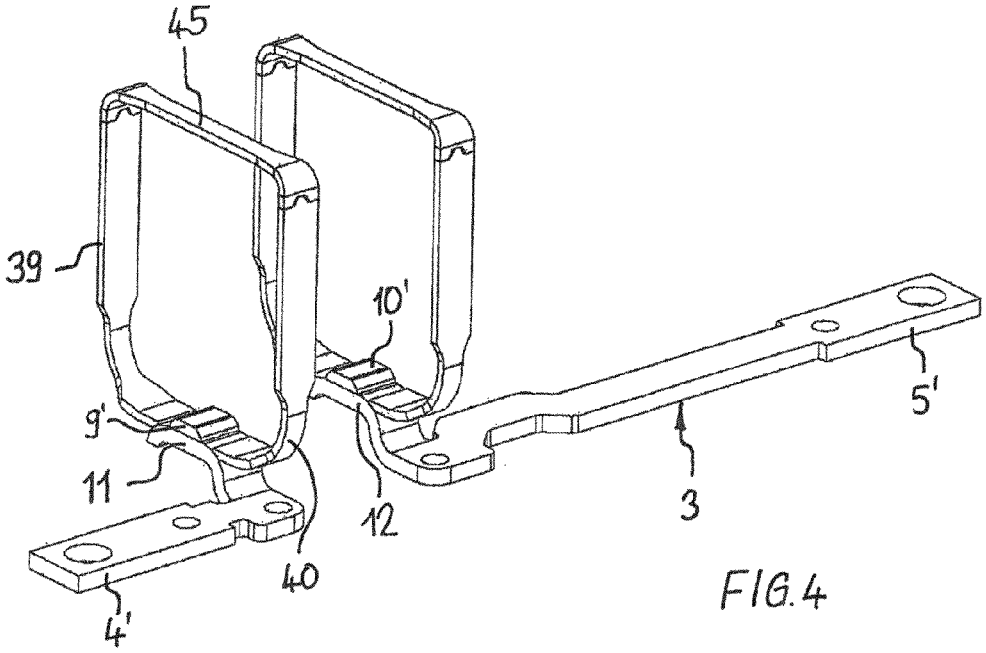
FIG. 4 shows a perspective diagram of the second current path in accordance with FIG. 2 with guide rail arrangements.

Due to the formation of a homogenous magnetic field with field lines from one of the first pole plates 29 to the other of the first pole plates 30, the magnetic field lines are perpendicular to the arc, so that a Lorentz force acts on it and drives the arc sideways away from the contact pair 7. The arc is then driven to the right or left, depending on the direction of current in accordance with FIG. 3. If, in accordance with FIG. 3, the arc is driven to the left, the first guide rail arrangement 37 guides the arc. If, in accordance with FIG. 3, the arc is driven to the right, the second guide rail arrangement 38 guides the arc. Both guide rail arrangements 37, 38 have a first guide rail 39, 40 and a second guide rail 41, 42, between which the arc spreads further. The first guide rails 39, 40 are connected to the first fixed contact support 11 (FIG. 4). The second guide rails 41, 42 are connected to the bridging contact member 15, where the second guide rails 41, 42 are presented as an integrated (single-piece) component, which runs one time around the side opposite to the first contact 9, and therefore it makes up a closed loop shaped as a ring.

The first guide rail 39 of the first guide rail arrangement 37 in FIG. 3 runs initially towards the left and is subsequently deflected 90° upwards, where the gap between the first guide rail 39 and the second guide rail 41 increases successively. The arc formed between these two guide rails 39, 41 therefore spreads further and is then driven from the first contact pair 7 at a first direction of current towards the left and then upwards. The arc will run further along the rear side of the bridging contact member 15 facing away from the first contact 9, where the arc is successively driven into the gaps between the individual extinguishing plates 23. Exhaust ducts 35 are provided on the top side of the first switching chamber 13 to blow the arc gases out of the housing 6.

The second guide rail arrangement 38 is constructed as an identical mirror-image of the first.

A comparatively low-energy arc will lose so much energy in the first extinguishing device 21 in the form of a deion extinguishing chamber due to forming several partial arcs and due to the cooling effect of the extinguishing plates 23 that it reaches the driving voltage quickly and, therefore, the arc is extinguished. In case of an arc with comparatively high energy content, for example in a strong inductive circuit, it can happen that the arc loses only part of its energy after entering the extinguishing chamber 21, and under the force of the blowout field generated by the permanent magnets, the partial arcs run through the entire length of the extinguishing chamber 21, and then finally they transfer to the connection base of the guide rails 39, 40 on the side of the fixed contact. Due to the continuous effect of the blowout field, an arc bridge is finally formed between the external (longer) plate of the extinguishing chamber 21 and the side section of the guide rails 39, 40 located on the side of the fixed contact, directly opposite to the extinguishing chamber, and hence the arc runs again in the direction of contacts 9, 18. After "passing" contacts 9, 18, the arc can run again along the guide rails 39, 40, 41, 42 in the direction of the extinguishing chamber 21. If the arc has sufficient energy remaining, one or several cycles of arc propagations can form until the arc loses so much energy that it extinguishes. Even if the arc voltage drops again for a short time after running through the extinguishing chamber 21 and transferring to the guide rail 39, 40 located on the fixed contact side, this voltage drop is quickly compensated due to the continuous forward movement of the arc and re-entry in the extinguishing chamber 21, and the arc voltage increases steadily until the arc finally extinguishes. However, the continuous thermal load generated by the arc causes a higher total load on the switching chamber for a longer period due to its continuous forward movement, the arc does not "burn into" the different areas of the switching chamber in this manner, which would cause a significant reduction of the lifetime of the switching device.

As presented in FIG. 4 showing the second current path 3, the first guide rails 39, 40 of both guide rail arrangements 37, 38 are connected to each other by a connecting bracket 45 at the side facing away from the first contact 7.

Figure 5:
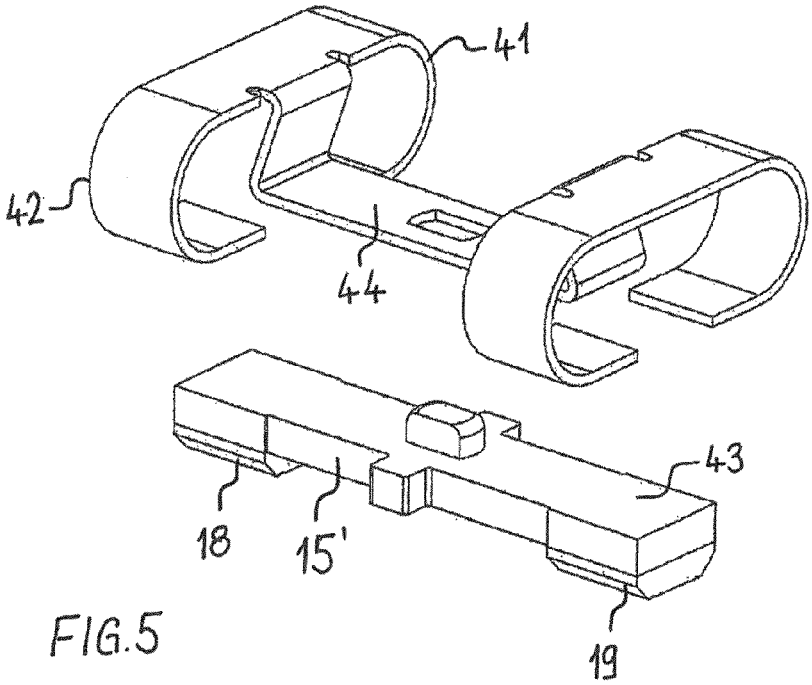
FIG. 5 shows a perspective diagram of a bridging contact member in accordance with FIG. 2, with guide rail arrangement.

FIG. 5 shows a perspective view of the bridging contact member 15, which demonstrates that the bridging contact member 15 is made up of two components, that is a contact support element 43, where the second contacts 18, 19 are fixed, and a guide rail element 44, which makes up the second guide rail 41, 42 for the first contact pair 7 and for the second contact pair 8.

Figure 7:
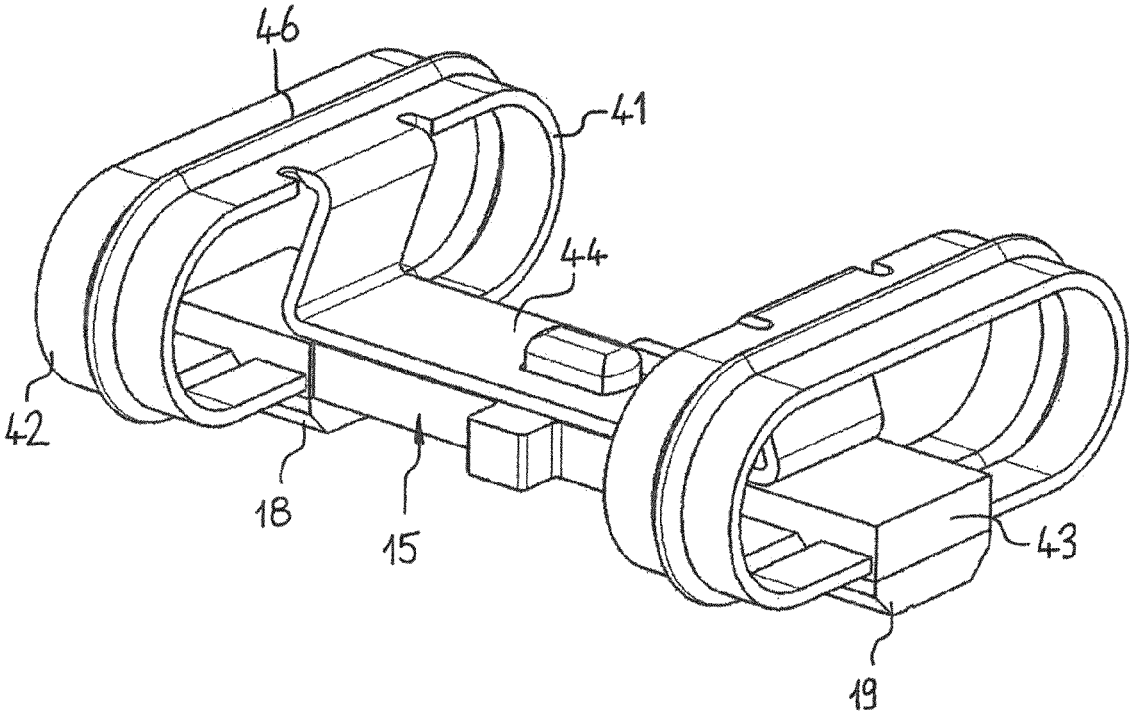
FIG. 7 shows a perspective diagram of an alternative embodiment of a bridging contact member with guide rail arrangement.

For the harmonious propagation properties of the arc, it is especially advantageous if the base points of the arc are preferably running along the middle of the guide rails 39, 40, 41, 42, because the probability of transferring the arc from the sides of the guide rails to areas in the vicinity of the walls of the switching chamber is significantly reduced, where it could generate increased thermal stress on the material. The above effect can be obtained in construction, as presented in FIG. 7, by applying impressions 46 on the first guide rails 41, 42 shaped as a ring, which run in the middle of the guide rails 41, 42 along their entire length or at critical parts, to form a ridge in the direction of the first guide rails 39, 40 located on the side of the fixed contact.

Figure 8:
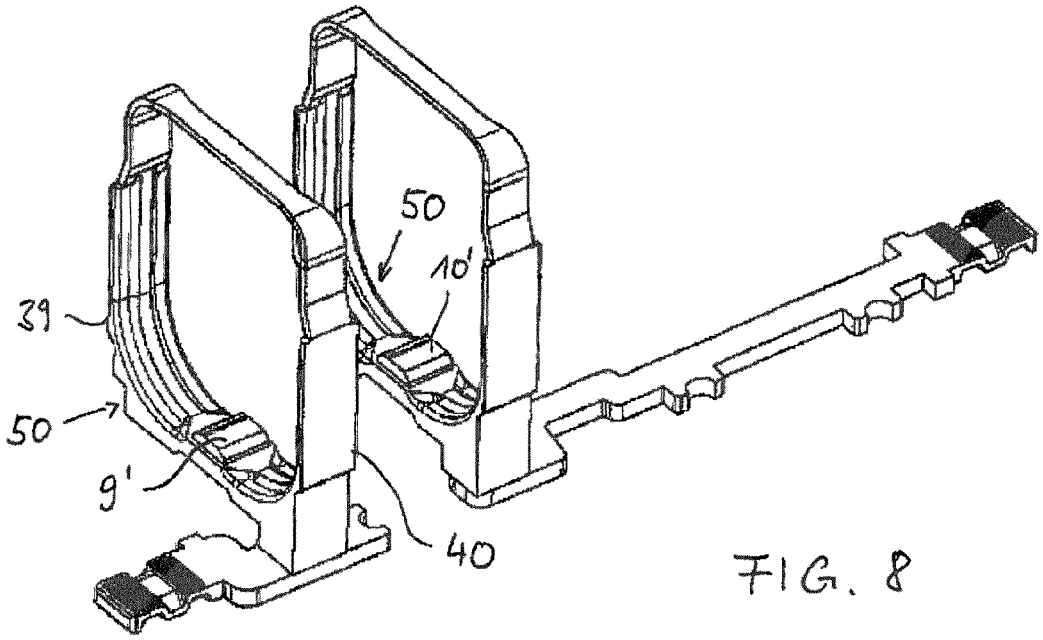
FIG. 8 shows a perspective diagram of the second current path in accordance with FIG. 4 with a first modified guide rail arrangement.
Figure 9:
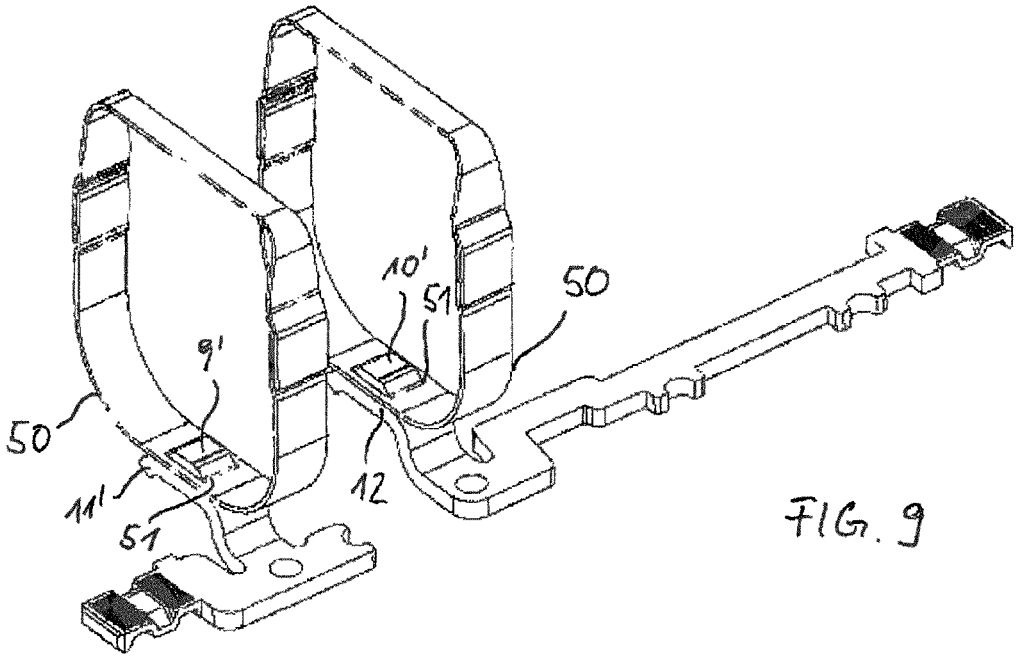
FIG. 9 shows a perspective diagram of the second current path in accordance with FIG. 4 with a second modified guide rail arrangement.

FIGS. 8 and 9 show a perspective view of the second current path in accordance with FIG. 4. With reference to FIGS. 8 and 9, we shall present two preferred embodiments concerning the guide rail arrangement. It is generally advantageous to reduce the number and/or size of the brackets or notches transverse to the direction of movement of the arc in the guide rail arrangement because partial arcs can form in the respective areas and these cause a significantly increased wear on the components, as presented for example in FIG. 3, where there is a kind of groove stretching from contact 9' to the first guide rails 39, 40. The arc must also overcome insulating soldering material, which hinders the transfer. In a preferred embodiment, both first guide rails 39, 40 make up an essentially U-shaped single conductive element 50, by preferably not having any joints. The embodiment according to FIG. 8 also provides that the first contacts 9', 10' are attached to the single-piece conductive element 50. The conductive element 50 manufactured by molding or hot stamping has an impression or an additional outline 46 here as well to keep the arc away from the edges of the conductive element.

FIG. 9 shows an alternative embodiment of the single-piece conductive element 50 with a cut 51, where the conductive element 50 can be mounted on the fixed contact supports 11' 12' in such a manner that the first contacts 9', 10' extend through the cut 51. The edges of the cut 51, which are preferably touching the sloped sides of the contacts 9', 10' and are preferably resilient, establish an electrical connection between the contacts 9', 10' and the conductive element 50. The conductive element 50 can be produced cost-efficiently as a simple punched and bent part.

Figure 10:
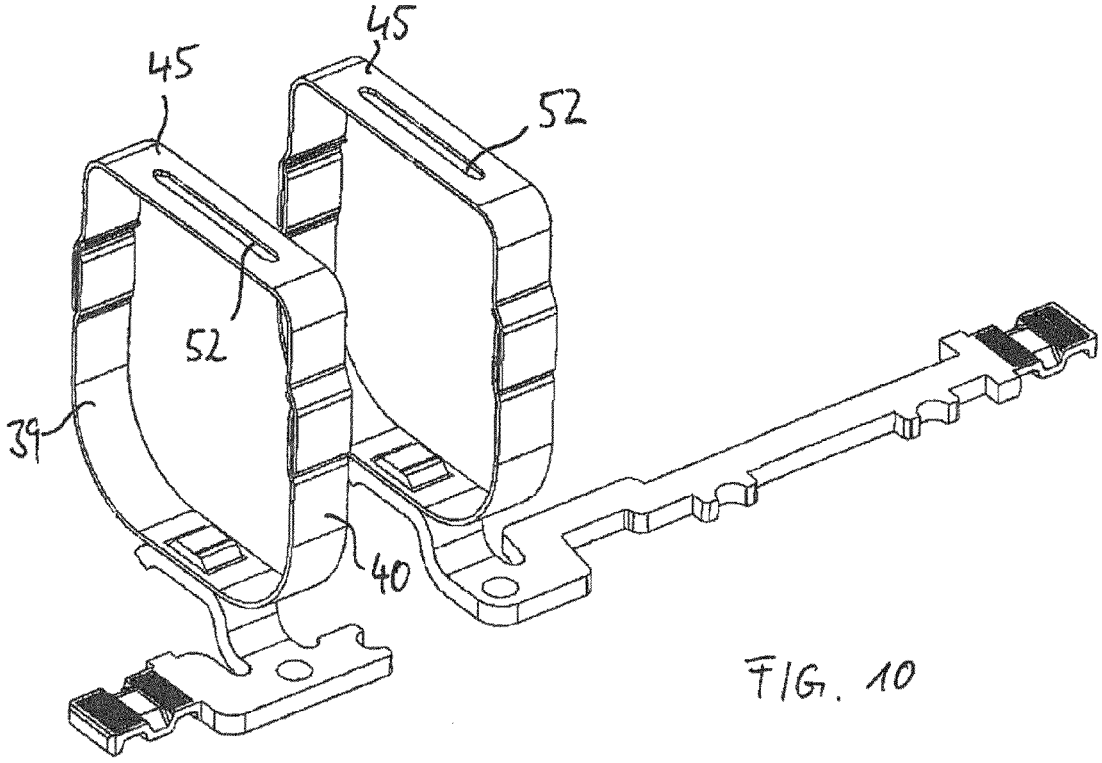
FIG. 10 shows a perspective diagram of the second current path in accordance with FIG. 4 with a third modified guide rail arrangement.

FIG. 10 shows a perspective diagram of the second current path in accordance with FIG. 4 with a further modification of the guide rail arrangement. For technical production reasons, it can be advantageous when the guide rail arrangements consist of several parts which are connected friction-locked during the assembly process. The two guide rails 39, 40 can be connected to each other by a connecting bracket 45. In an especially preferred embodiment, the connecting bracket 45 has a cut 52 running approximately in the middle along the closed loop for centering the arc, that is the cut 52 runs in the direction of the movement of the base point of the arc. The base points of the arc run preferably along sharp and conductive edges. When the outside edges of the bracket 45 are covered by the attaching housing walls, the arc is preferably driven on the edges of the middle cut 52. The arc is centered in this manner, displaced from the ideal middle position only by half the width of the gap. In addition, the gases produced during the switching operation can be blown out through the cut 52.

Figure 11:
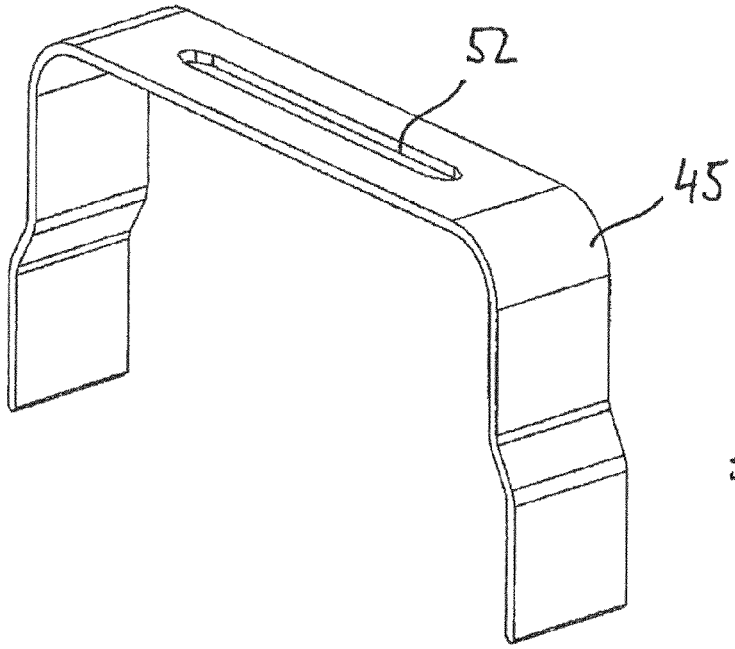
FIG. 11 a separate component from FIG. 10 in detail.

FIG. 11 shows the connecting bracket 45 with the cut 52 as a separate piece. The cut can be manufactured preferably using a cutting punch.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE SYMBOLS

1 Switching device
2 first current path
3 second current path
4, 4' first connection
5, 5' second connection
6 housing
7, 7' first contact pair
8, 8' second contact pair
9, 9' first contact
10, 10' first contact
11, 11' fixed contact support
12, 12' fixed contact support
13, 13' first switching chamber
14, 14' second switching chamber
15, 15' bridging contact member
16 first side
17 second side
18, 18' second contact
19, 19' second contact
20, 20' switching bridge
21, 21' first extinguishing device
22, 22' second extinguishing device
23 extinguishing plates
24, 24' first arc driver assembly
25, 25' outer pole element
26, 26' inner pole element
27 base bridge
28 base bridge
29 first pole plate
30 first pole plate
31 second pole plate
32 second pole plate
33 permanent magnet
34 opening
35 blow-out channel
36 insulating element
37 first guide rail arrangement
38 second guide rail arrangement
39 first guide rail
40 first guide rail
41 second guide rail
42 second guide rail
43 contact support element
44 second guide rail
45 connecting bracket
46 impression
50 single-piece conductive element
51 cut
52 cut

The invention claimed is:

1. A switching device for direct current operation, the device comprising:

a contact pair including a fixed first contact and a movable second contact; and an extinguishing device including:

an extinguishing chamber configured to extinguish arcs produced between the first contact and the second contact, a first guide rail arrangement configured to guide arcs with a first direction of current into the extinguishing chamber, and a second guide rail arrangement configured to guide arcs with a second direction of current into the extinguishing chamber, wherein each of the first guide rail arrangements and the second guide rail arrangement includes a first guide rail and a second guide rail, wherein the first guide rail of the first guide rail arrangement and the first guide rail of the second guide rail arrangement, starting from the fixed first contact, extend in opposite directions and then towards the extinguishing chamber and are connected to each other in a conductive link forming a closed loop, and wherein the second guide rails, starting from the movable second contact, extend in opposite directions, the second guide rails being configured to be movable with the movable second contact.

2. The device of claim 1, wherein the first guide rails are connected in an electrically conductive arrangement on a side of the movable second contact facing away from the fixed first contact.

3. The device of claim 1, wherein the first guide rails are connected to each other by a connecting bracket.

4. The device of claim 3, wherein the connecting bracket includes a cut running approximately in the middle along the closed loop configured to center the arc.

5. The device of claim 1, wherein the second guide rails are connected to each other conductively forming a closed loop.

6. The device of claim 1, wherein the second guide rails are connected in an electrically conductive arrangement on a side of the movable second contact facing away from the fixed first contact.

7. The device of claim 1, wherein the first guide rails make up a single piece conductive element which is essentially U-shaped.

8. The device of claim 7, wherein the fixed first contact is formed at the single-piece conductive element.

9. The device of claim 7, wherein the single-piece conductive element includes a cut, and wherein the conductive element can be mounted on a fixed contact support so that the fixed first contact extends through the cut.

10. The device of claim 1, wherein at least one of the guide rails includes a ridge at least partly in a direction of propagation of the arc and facing in a direction of the other guide rail.

11. The device of claim 1, further comprising:

an arc driver assembly creating a magnetic field in the region of the contact pairs, wherein the arc driver assembly includes an outer pole element and an inner pole element, and wherein both pole elements have U-shaped profiles including a base bridge and two pole plates protruding from the base bridge.

12. The device of claim 11, wherein the inner pole element is arranged within the outer pole element, wherein at least one permanent magnet is arranged between the base bridge of both pole elements, and wherein a contact pair is arranged each between one pole plate of the outer pole element and one pole plate of the inner pole element.

13. The device of claim 1, wherein the first guide rails are integrally included in a single-piece conductive element which is essentially U-shaped.

14. The device of claim 1, wherein the conductive link forming a closed loop includes the fixed first contact.

15. The device of claim 1, wherein the closed loop formed by the first guide rails surrounds the extinguishing chamber.

* * * * *